United States Patent [19]

Warnock

[11] 4,423,980

[45] Jan. 3, 1984

[54] TRUCK-MOUNTED APPARATUS FOR REPAIRING ASPHALT

[76] Inventor: Denny F. Warnock, 6100 W. Stonehedge, Greenfield, Wis. 53220

[21] Appl. No.: 256,900

[22] Filed: Apr. 23, 1981

[51] Int. Cl.[3] ..... E01C 19/00

[52] U.S. Cl. ..... 404/83; 404/111; 296/37.6

[58] Field of Search ..... 404/111, 108, 75, 83; 296/37.6

[56] References Cited

U.S. PATENT DOCUMENTS

| | | | |
|---|---|---|---|
| 1,714,659 | 5/1929 | Chausse | 404/108 |
| 1,864,612 | 6/1932 | Pearson | 404/108 X |
| 3,217,620 | 11/1965 | Mindrum | 404/108 X |
| 3,260,176 | 7/1966 | Bowers | 404/111 |
| 3,285,147 | 11/1966 | Gruvris | 404/111 X |
| 3,608,446 | 9/1971 | Plant | 404/83 |
| 4,198,177 | 4/1980 | Ray | 404/83 X |
| 4,311,274 | 1/1982 | Neal | 404/111 X |

*Primary Examiner*—Nile C. Byers, Jr.

[57] ABSTRACT

Dump-truck mounted apparatus for repairing asphalt comprises a truck engine which drives first and second hydraulic pumps located on the truck chassis. One pump supplies pressurized hydraulic fluid to operate a lift cylinder which raises and lowers the dump truck box, to operate hydraulic tools and to drive a hydraulic motor which drives an emulsion pump for expelling liquid emulsion from an emulsion storage tank which are located on a cabinet detachably mounted on the dump truck box. The other pump supplies pressurized hydraulic fluid to operate a hydraulic motor on the cabinet which, in turn, drives an air compressor on the cabinet to charge a compressed air tank on the cabinet for supplying pneumatic tools. Reeled hoses are provided for supplying hydraulic fluid and compressed air to their respective tools and for supplying emulsion from the storage tank. Engine heat is supplied via a liquid coolant to heaters in the emulsion storage tank and emulsion pump to liquify the emulsion. A solvent tank is provided on the cabinet to feed solvent to flush the emulsion storage tank and emulsion lines. The dump box includes improved tool storage compartments.

7 Claims, 14 Drawing Figures

TRUCK-MOUNTED APPARATUS FOR REPAIRING ASPHALT

BACKGROUND OF THE INVENTION

1. Field of Use

This invention relates generally to truck-mounted apparatus for repairing or patching asphalt. In particular, it relates to hydraulic circuitry and components employed in such apparatus.

2. Description of the Prior Art

It is convenient and economical to provide a vehicle, such as a light truck, with the apparatus, equipment, tools and supplies needed to effect the repair of pot holes and cracks in small areas of asphalt pavement. U.S. Pat. No. 4,198,177 issued Apr. 15, 1980 for "Method And Apparatus For Repair Of Asphalt Surfaces" discloses the state of the art. That patent discloses a system for repairing asphalt surfaces including an emulsion tank, air pressure source, emulsion heating source, pneumatic tools and a vehicle having a fluid-cooled engine and a utility body for containing asphalt repairing material. The improvement comprises an emulsion tank removably mounted on the vehicle for containing a water-soluble, air-cured, sealer-bonding agent, an air compressor mounted on and driven by the vehicle engine, an air storage tank removably mounted on the vehicle and coupled to the compressor and pressurized thereby, means for selectively coupling air from said pressurized tank to said pneumatic tools and said emulsion tank and means coupling said vehicle cooling fluid to said emulsion tank for heating said emulsion to a usable temperature whereby certain of said pneumatic tools may be selectively driven by said compressed air in said storage tank to trim a damaged asphalt surface, spray emulsion over said trimmed surface under pressure from said compressed air tank, and compact said asphalt repairing material into said trimmed and sealed area thereby repairing said damaged asphalt area.

SUMMARY OF THE PRESENT INVENTION

In accordance with the present invention there is provided improved truck-mounted apparatus for repairing or patching asphalt. Apparatus in accordance with the invention generally comprises a vehicle, such as a truck, having a chassis, and tiltable dump box mounted on the chassis, a patcher cabinet removably mounted on the dump box, and a water-cooled truck engine on the chassis which drives a pair of hydraulic pumps mounted on the chassis for first and second hydraulic circuits. The first circuit is supplied by the first pump to supply pressurized fluid to operate a lift cylinder which raises and lowers the dump box, to operate hydraulic tools and to drive a hydraulic motor on the cabinet which, in turn, drives an emulsion pump on the cabinet for forceably expelling emulsion from an emulsion storage tank on the cabinet. The second circuit is supplied by the second pump to drive a hydraulic motor which, in turn, drives an air compressor on the cabinet to charge a compressed air tank on the cabinet. The compressed air is available to operate pneumatic tools and to blow dirt and foreign materials out of cracks in pavement. The hydraulic fluid for the tools, the air for the tools and the emulsion are supplied through reeled hoses located on the chassis and cabinet, respectively. Engine heat is supplied by means of circulating engine coolant to heaters in the emulsion storage tank and in the emulsion pump jacket to liquify the emulsion. A solvent tank is provided on the cabinet to flush the emulsion storage tank and its associated components. The dump box includes novel tool storage compartments.

Apparatus in accordance with the invention offers several advantages over the prior art. For example, the availability of pressurized air and hydraulic fluid to drive various components and types of tools enhances the utility of the apparatus. The newly designed and cool-operating hydraulic system provides for powering the wide assortment of hydraulic tools available today. Compressed air is also provided for blowing moisture, dirt and dust away from area to be patched, blowing dirt and foreign material out of cracks in pavement, and is also available for air tools and sprayers. Heated asphalt emulsion is delivered under pressure at a much higher velocity than in gravity fed systems and provides for better penetration and bonding. The solvent tank for flushing the emulsion circuit also is available for cleaning of equipment, tools and hands. Heavy duty hose reels are provided to conveniently handle hoses for the emulsion, and the compressed air and hydraulic tools. Gauges, regulators and valves conveniently located on the cabinet indicate emulsion temperature, control air and hydraulic flow rate and pressures. Tool storage compartments are provided in the cabinet and dump box for storing hand-held tools. The patcher cabinet can be removed in a short time, such as twenty minutes or less, yet, the truck still has a complete hydraulic system for tools and can be used for other work. The apparatus can be used in conjunction with trailer mounted hot boxes, portable asphalt reclaimers and other trucks. The emulsion is positively expelled umder relatively high constant pressure from its heated storage tank by a hydraulically driven gear pump and thus is well-suited for penetrating narrow cracks in asphalt which heretofore have been difficult to repair or fill with emulsion fed by gravity or at low pressure or in pulsating streams. Other objects and advantages will hereinafter appear.

DRAWINGS

DESCRIPTION OF A PREFERRED EMBODIMENT

Figure 1:
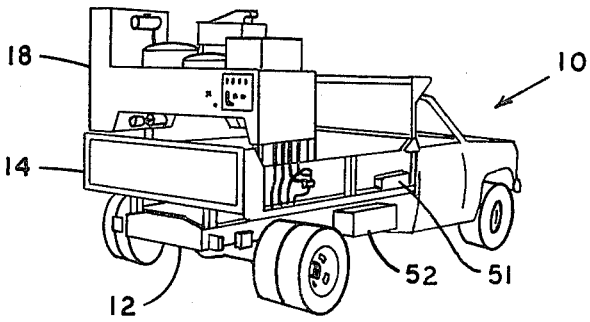
FIG. 1 is a right rear perspective view of a patcher cabinet mounted on the dump box of a dump truck and employing apparatus in accordance with the invention.
Figure 4:
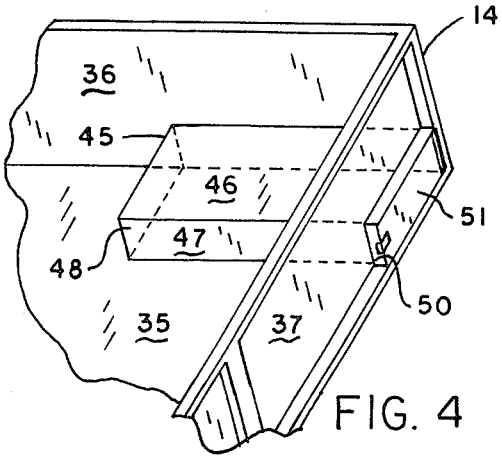
FIG. 4 is an enlarged perspective view of a tool storage compartment in the dump box.
Figure 2:
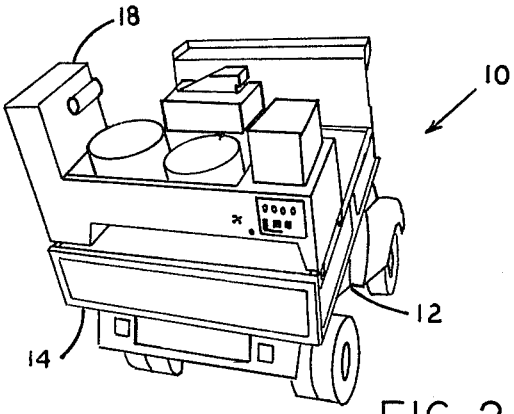
FIG. 2 is a view similar to FIG. 1 but showing the dump box raised.

Refering to FIGS. 1 and 2, the numeral 10 designates a vehicle, such as a single rear axle dump truck, having asphalt repairing apparatus thereon in accordance with the invention. Truck 10 comprises a chassis 12 including rails 12A and 12B having a dump box or body 14 tiltably mounted thereon which can be raised (FIG. 2) and lowered (FIG. 1) by means of a hydraulic lift cylinder 16 (see FIG. 8) which is pivotally connected between the chassis 12 and dump box 14. A patcher cabinet 18 is detachably or removably mounted on dump box 14, preferably near the rear end thereof, as by means of attachment legs 141A and 141B (FIGS. 9 and 11) having bolts thereon, and the dump box is provided with a swingable tail gate 39 and with storage compartments 42 (FIG. 3) and 45 (FIG. 4).

Figure 13:
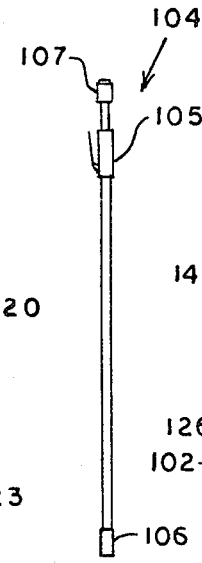
FIG. 13 is a plan view of an air wand.
Figure 14:
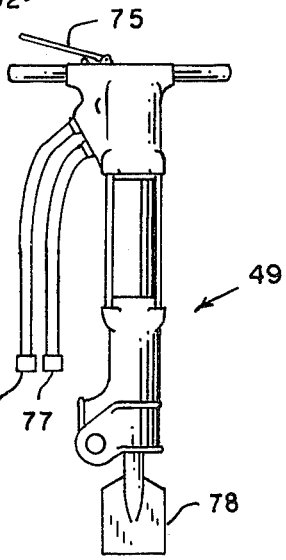
FIG. 14 is a plan view of a hydraulic paving breaker.

As hereinafter explained, the asphalt repairing apparatus employs an emulsion application or spray wand 120 (FIG. 12), an air wand 104 (FIG. 13), and a hydraulic paving breaker 49 (FIG. 14) which are stored on vehicle 10 when not in use. Spray wand 120 includes a handle, an on-off valve 122 and a nozzle 123. Air wand 104 is a hollow tube which is about 3' long and includes an on-off spring-loaded lever-operated valve 105, a nozzle 106 and a quick-disconnect coupling 107. Paving breaker 49 includes a blade 78, a control lever 75, and supply and return connectors 76 and 77, respectively.

As FIGS. 1, 2, 3 and 7 show, dump box 14 includes a floor 35, a front side 36, lateral sides 37 and 38, and a hinged tail gate 39 which fits in standard tailgate sockets 40 or 41 and folds either up or, if preferred, down for access to patching materials (not shown) carried in the dump box and to allow gravity discharge of loose materials (not shown) such as old waste asphalt removed from a repaired area.

Figure 3:
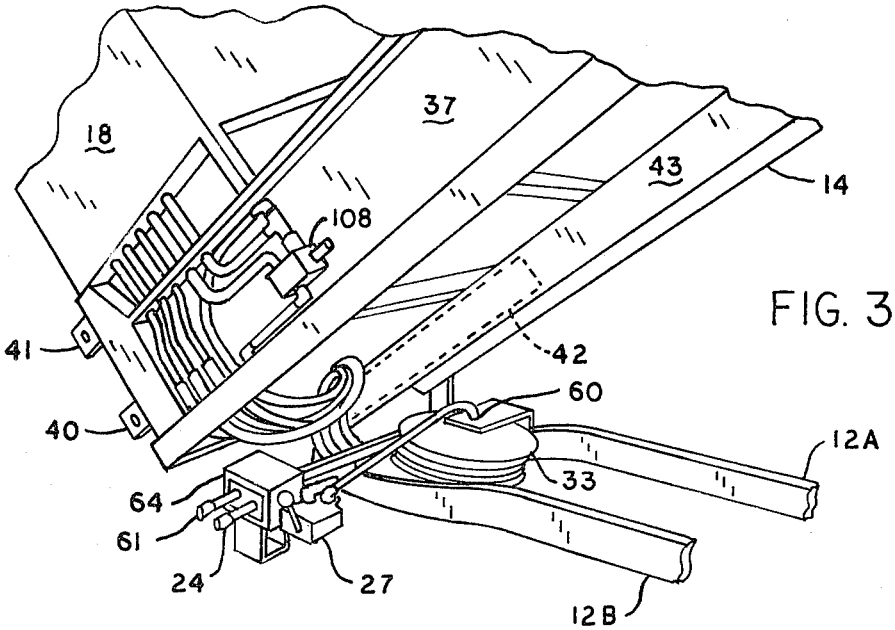
FIG. 3 is a right front enlarged perspective view of a hose reel on the truck chassis beneath the raised dump box.
Figure 5:
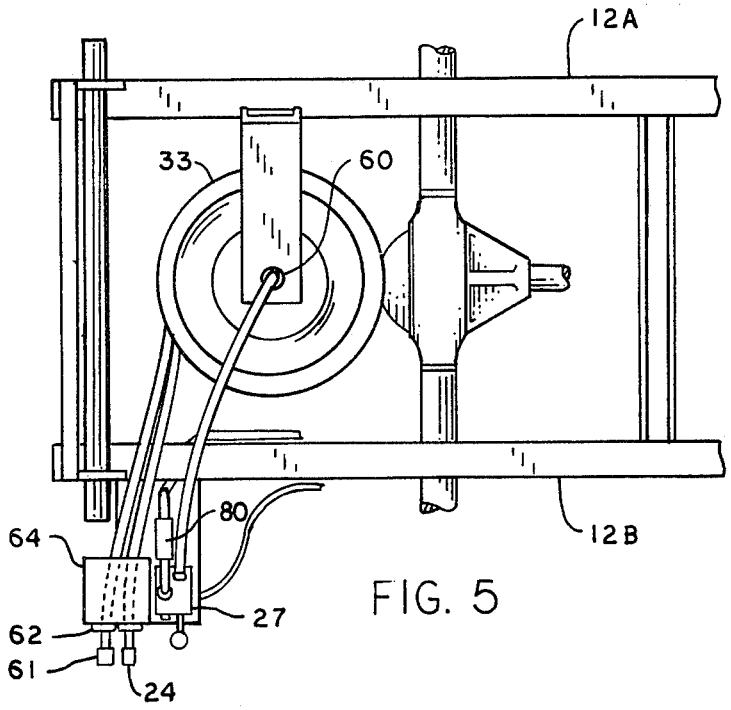
FIG. 5 is an enlarged top plan view of the hose reel shown in FIG. 3.
Figure 6:
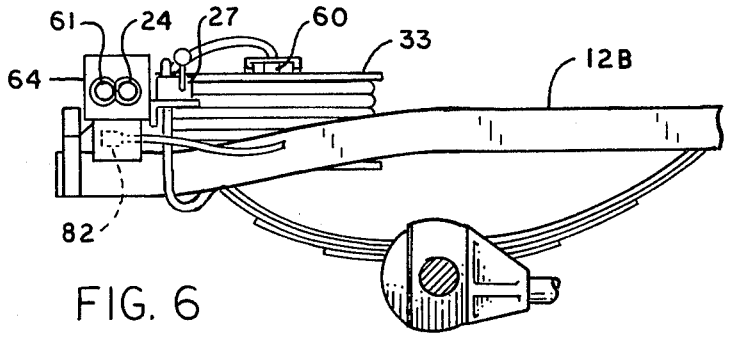
FIG. 6 is a side elevation view of the hose reel shown in FIG. 5.
Figure 7:
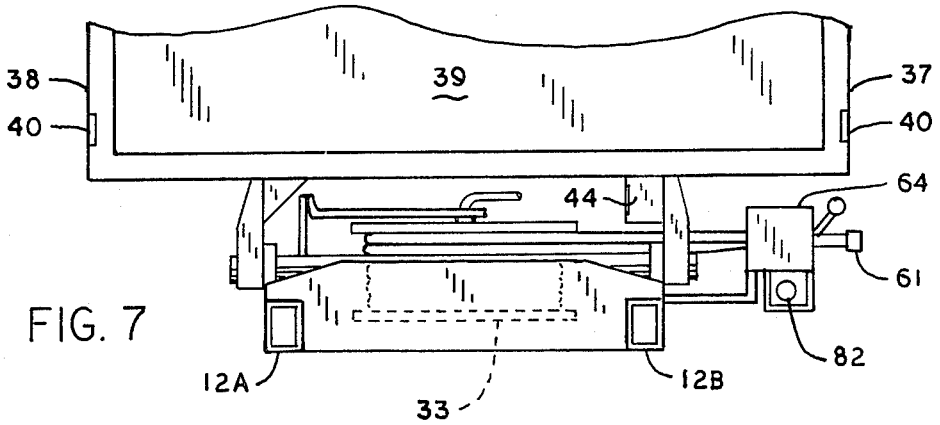
FIG. 7 is an end elevation view of the hose reel shown in FIG. 5.

As FIG. 3 shows, dump box 14 is provided with tamper tool tunnel storage compartment 42 along the right longitudinal channel 43 beneath dump box 14 and this compartment is provided with a hinged door 44 (FIG. 7) at the rear thereof.

As FIG. 4 shows, dump box 14 is also provided with paving breaker storage compartment 45 located in the right front corner of the dump box and defined by portions of front side 36, lateral side 37 and floor 35, and by a top wall 46, a side wall 47 and an end wall 48. Access to the interior of compartment 45 is through an opening 50 in lateral side 37 of dump box 14, which opening is provided with a lockable hinged door 51 mounted on side 37. Compartment 45 affords easy access to the paving breaker machine 49 (FIG. 14) storable therein and also prevents the machine from sliding out of dump box 14 when the latter is raised to discharge waste asphalt.

As FIGS. 1, 2, 3, 9, 10 and 11 show, patcher cabinet 18 is on the order of 84" long, 30" deep and 51" high and includes a tool storage compartment 31 having a hinged door 32 with a recessed lock 34 and includes therewithin sockets (not shown) and brackets (not shown) for holding tools such as paving breaker 49 (FIG. 14) a moil point (not shown), air wand 104 (FIG. 13), emulsion wand (FIG. 12), compactor pad (not shown), hand tools (not shown), etc.

Figure 8:
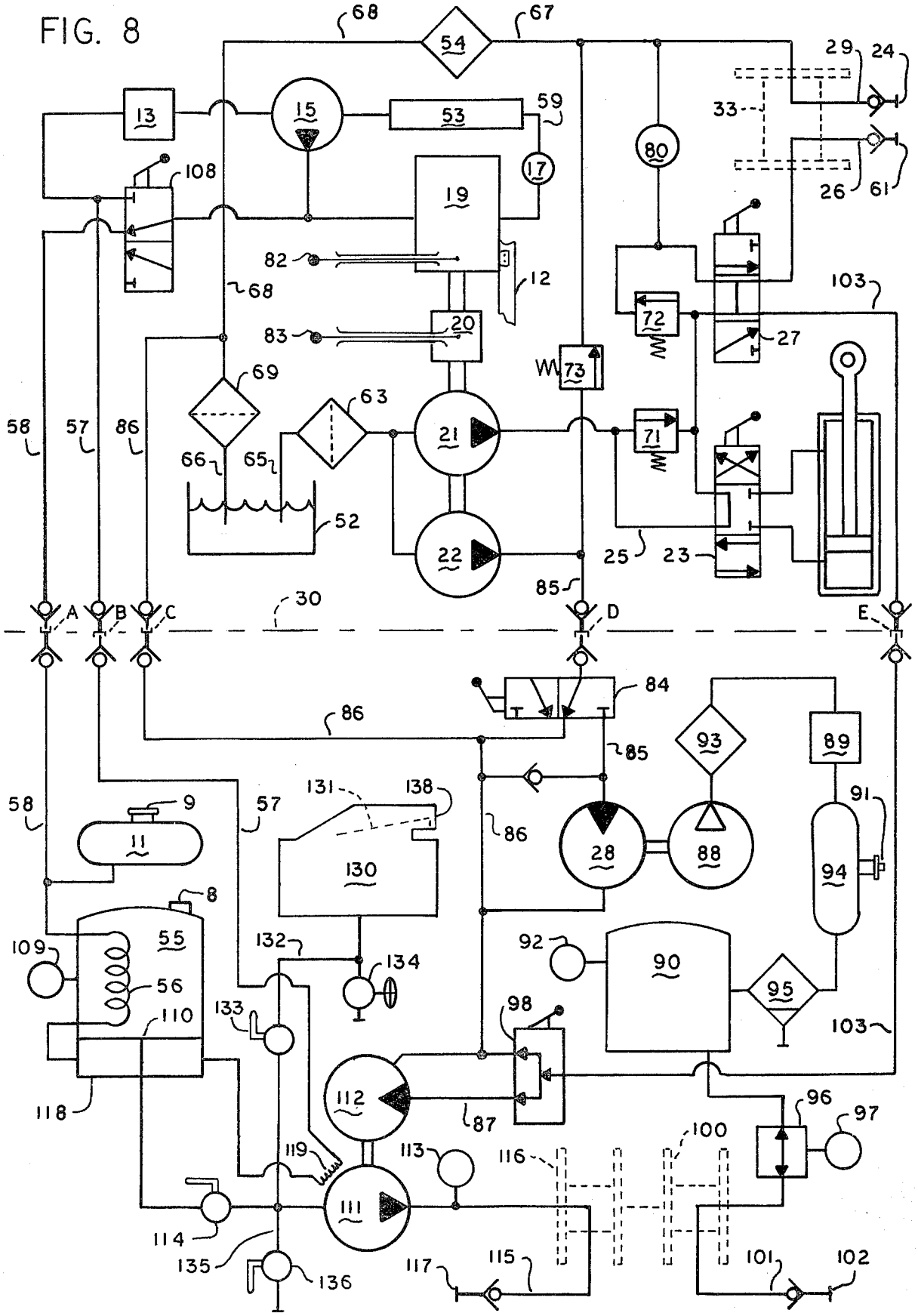
FIG. 8 is a hydraulic circuit diagram, including some conponents in schematic form, of the apparatus in accordance with the invention.

Referring now to FIG. 8 it is seen that vehicle chassis 12 supports a liquid cooled internal combustion engine 19 which propels vehicle 10. Engine 19 is provided with a power take-off unit 20 which drives a pair of tandem-mounted hydraulic gear pumps 21 and 22 which are located on chassis 12; each pump being rated, for example, at 9 GPM at 850 RPM at 2000 PSI.

Pump 21 is part of and supplies pressurized hydraulic fluid to a first hydraulic circuit which is located partly on vehicle chassis 12 and partly on cabinet 18 (above and below dashed line 30 in FIG. 8) which performs three functions, namely: supplies operating fluid for lift cylinder 16 for dump box 14, supplies operating fluid to drive hydraulically powered tools, such as paving breaker 49, and supplies operating fluid to a patcher cabinet mounted hydraulic motor 112, which drives an emulsion pump 111.

Figure 9:
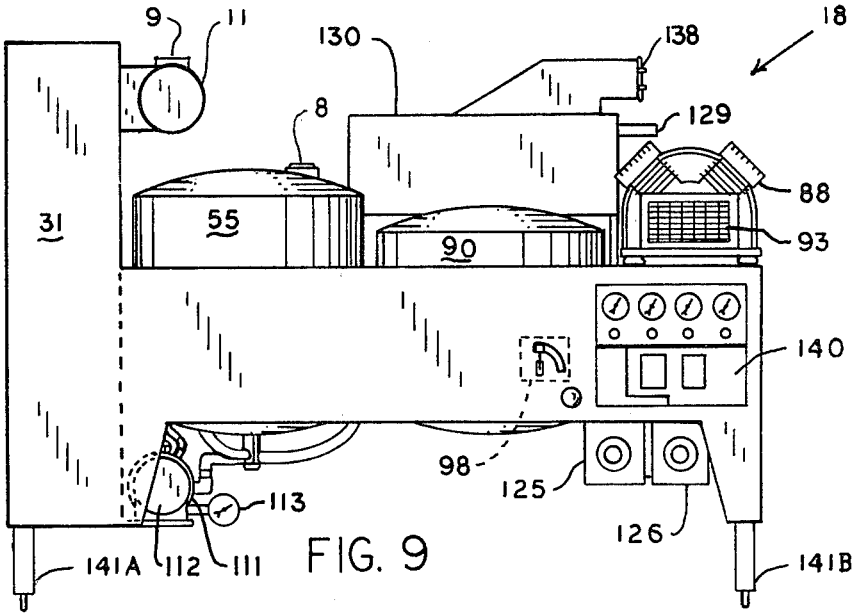
FIG. 9 is a rear elevation view of the patcher cabinet.
Figure 10:
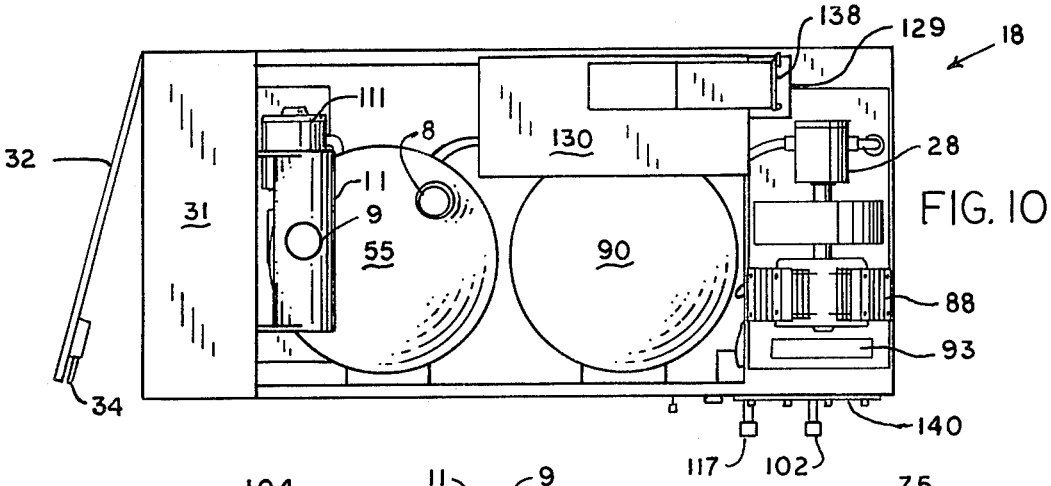
FIG. 10 is a top plan view of the patcher cabinet.
Figure 11:
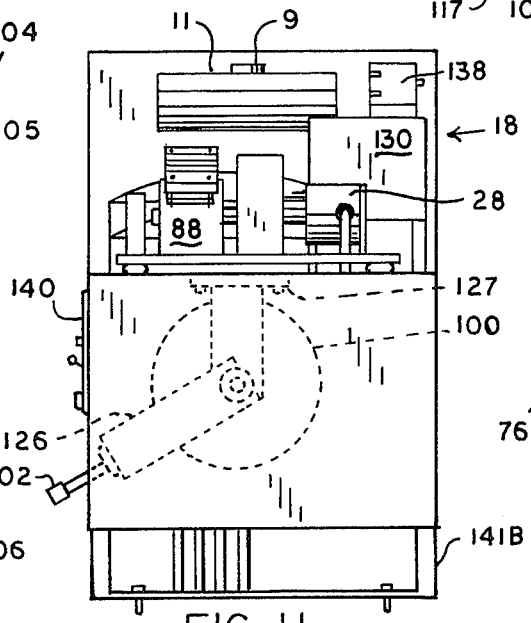
FIG. 11 is right side elevation view of the patcher cabinet.

Pump 22 is part of and supplies pressurized hydraulic fluid to a second hydraulic circuit which is located partly above and partly below line 30 in FIG. 8 and operates the apparatus, hereinafter described, in cabinet 18 which is detachably mounted on dump box 14. Generally considered, and as FIGS. 8 through 11 show, such apparatus includes a hydraulic motor 28 driven by pump 22, an air compressor 88 driven by motor 28, a compressed air tank 90 supplied by air compressor 88 (having a cooler 93), an emulsion tank 55, the hydraulic motor 112 supplied from and driven by fluid from pump 21, an emulsion pump 111 driven by hydraulic motor 112 for expelling emulsion from tank 55, and a pneumatic circuit, hereinafter described, which is supplied from compressed air tank 90 and operates to supply compressed air to drive pneumatically powered tools, such as a compactor (not shown), or supply air wand 104. The apparatus further includes a heater coil 56, a heater chamber 118, and a pump jacket 119 which are physically associated with emulsion tank 55 and pump 111, respectively, so as to heat and make liquid the emulsion therein and which is supplied with heated coolant liquid from the cooling system for engine 19 through a two-position coolant selector valve 108 (FIGS. 3 and 8) in a coolant supply line 58. The cooling system includes a radiator 53 connected on one side to engine 19 by a coolant hose 59 having a thermostat 17 therein and on its other side to heater coil 56 in emulsion tank 55 through a coolant return line 57 in which a cab heater 13 and a water pump 15 are located. A coolant supply tank 11 having a fill port 9 connects to coolant supply line 58 and is located on the outside of compartment 31 of cabinet 18 (FIGS. 9–11).

Referring to FIGS. 3, 5, 6, 7, and 8, the aforementioned first and second hydraulic circuits which are supplied by pumps 21 and 22, respectively, will now be described in more detail. As FIG. 8 shows, both pumps are supplied with fluid from a reservoir 52 (40 gallons, for example) through a line 65 which has a filter 63 therein. Engine 19 is provided with a remote control throttle 82 which is physically located at the right rear corner of chassis 12 (FIGS. 6 and 7) so that pump speed can be maintained at desired levels by the machine operator to provide hydraulic fluid pressure at desired levels, depending on work load demands. The power take-off unit 20 is provided with a cab-mounted engage-disengage control member 83.

Pump 21 supplies pressurized fluid through a supply line 25 to a three-position (neutral, up, down) spool type manually operable control valve 23 for dump box lift cylinder 16. Fluid is also supplied from valve 23 (regardless of the latter's position) to a three position (on-off-on) three-way spool type manually operable control valve 27 for a hydraulic fluid supply hose 26. The valve 23 for lift cylinder 16 is understood to be physically located between the frame rails of the chassis or under the truck cab, whereas the valve 27 for supplying pump 112 and tools is conveniently located at the right rear corner of chassis 12. The valves 23 and 27 have pressure relief valves 71 and 73, respectively, associated therewith and an oil flow monitoring gauge 80 (FIGS. 5 and 8), an oil cooler 54 in front of radiator 53 and a filter 69 provided in the return lines 67, 68, 66 to reservoir 52 from the valves 23 and 27. Fluid return line 67 is connected to a hydraulic fluid return hose 29.

The hoses 26 and 29, each of which preferably takes the form of a 40 foot long, ½" diameter one-wire braid hydraulic hose, are wound on a spring-retractable dual-hose reel 33 which, as FIGS. 3, 5, 6 and 7 show, is mounted on a vertical axle 60 on chassis 12 between the rails 12A and 12B. The hoses 26 and 29 are provided at their outermost ends with valve-type quick disconnects 61 and 24, respectively, whereby a hydraulic tool, such as breaker 49 may be attached thereto by its connectors 76 and 77, respectively. A hose guide 64 having a pair of hose stops 62 therein is provided at the right rear corner of chassis 12 to facilitate hose-end accessibility and to allow the hoses to be pulled out clear of dump box 14 to the rear or front of the truck.

As FIG. 8 shows, pump 22 is connected by a hydraulic fluid supply line 85 to supply a two-position (on-off) manually operable hydraulic motor control valve 84 for hydraulic motor 28 on cabinet 18. Fluid is returned from motor 28 to reservoir 52 through a fluid return line 86 and line 66.

As FIGS. 3 and 8 show, the coolant return line 58, the coolant supply line 57, the hydraulic fluid return line 86 and the hydraulic fluid supply lines 85 and 103 are provided with quick-disconnect or detachable connectors A,B,C,D and E, respectively, to facilitate mounting or removal of the patcher cabinet 18 on dump box 14 of vehicle 10.

When valve 84 is operated to permit hydraulic motor 28 to drive air compressor 88, compressed air is supplied through an air cooler 93, through an automatic air unloader vlave 89 (operable to deliver 22 CFM of air at 90 psi, for example) to an air receiver 94 (which has a pop-off valve 91 thereon) and from thence through a water separator 95 to air tank 90 which has an air pressure gauge 92 thereon.

Compressed air from air tank 90 is supplied through an air pressure regulator valve 96, which has an air pressure gauge connected thereto, to an air hose 101. Air hose 101 which takes the form of a 40 foot long ½" in diameter one-wire braid air hose, is wound on a spring-retractable single hose reel 100 which, as FIG. 11 shows, is mounted on cabinet 18 for rotation about a horizontal axis by means of a mounting bracket 127. Reel 100 includes a hose guide 126. Air hose 101 is provided at its outermost end with a valve-type quick disconnect 102 whereby a pneumatically powered tool, such as a compactor (not shown), or air wand 104 may be attached thereto by its connector or coupling 107.

Figure 12:
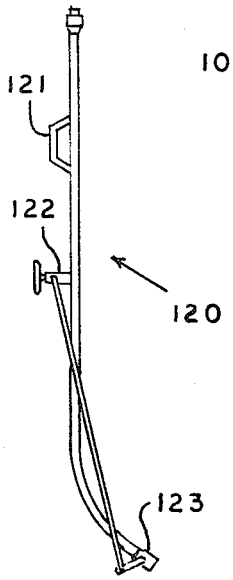
FIG. 12 is a plan view of an emulsion wand.

Hydraulic fluid from valve 27 is supplied by line 103 through a hydraulic metering valve 98 to the hydraulic motor 112 for emulsion pump 111. Emulsion tank 55 has a fill-port 8 and a temperature guage 109. The discharge port 110 of emulsion tank 55 is connected through a first manually operable on-off valve 114 to the intake side of emulsion pump 111. Pump 111 can deliver up to 5.5 gpm of emulsion at up to 400 psi nozzle pressure to achieve better emulsion penetration and bonding of the emulsion tack coat. The discharge port of pump 111 contains a pressure gauge 113 and is connected to one end of a hose 115 which is mounted on a hose reel 116 on cabinet 18. The other end of hose 115 has a quick-disconnect fitting 117 for connection to emulsion spray wand 120. Reel 116 includes a hose guide 126. As FIG. 12 shows, spray wand 120, for example, takes the form of a 5' long steel tube having a handle 121, a drip-free shut-off valve 122, and an 80° nozzle tip 123. Hose 115 and reel 116 are similar in construction to hose 101 and reel 100, respectively, hereinbefore described.

A solvent tank 130 is provided on cabinet 18 for a liquid such as deisel oil for flushing out the emulsion suction and discharge circuits downstream of its discharge port 110 and for cleaning tools, equipment and hands. Tank 130, which is connectable to tank 55 and to pump 111 and to a drain valve 136 by a line 132 having a manually operable shut-off valve 133 therein, is also provided with a separate drain circuit 137 which has a manually operable shut-off valve 134 therein. Tank 130 has a large capped opening 138, with a baffle 131 therein, for insertion of the emulsion spray wand tip 123, for example, to allow for recirculation of solvent during flushing. A drip tray 129 is located beneath opening 138.

Referring to FIGS. 8 and 9, it is to be understood that the following component shown therein are mounted on a instrument panel 140 on cabinet 18: air tank pressure gauge 92; air tool circuit pressure regulator 96 and guage 97 hydraulic metering valve 98, and emulsion temperature guage 109.

The apparatus hereinbefore described is operated in the following manner. Assume that truck 10 is at a job site and that engine 19 and powertake-off unit 20 are in operation and that pumps 21 and 22 are being driven thereby. Further assume that control valve 84 is "on", that motor 28 is driving air compressor 88 and that air reservoir 90 is charged, and that emulsion storage tank 55 and flush tank 130 are filled with appropriate liquids. Also assume that control valve 23 is closed so that dump box 14 is in down position; and that three-position hydraulic tool control valve 27 is either in tool mode or pump mode thereby driving motor 112 and emulsion pump 111. Also assume that hoses 26, 29 for hydraulic tools are extended from reel 33, that hose 101 for air tools is extended from reel 100, and that hose 115 for emulsion spray wand 120 is extended from reel 116. Also assume that a paving breaker 49, compressed air wand 104 and an emulsion spray wand 120 are connected to their appropriate connectors 61, 24; 102 and 117, respectively.

Under these assumed conditions, the paving breaker 49 can be operated to break out a defective section of asphalt, the airwand 104 can then be employed to blow out debris and dry the hole after broken asphalt is removed therefrom, and emulsion spray wand 120 can then be employed to apply a coating of emulsion to the clean, dry hole. When this is done, the air wand 104 may be disconnected and a pneumatically operated compactor (not shown) may be substituted for the air wand and used to compact new asphalt material which is placed in the hole. Or, if preferred, the paving breaker 49 may be disconnected and a hydraulically operated compactor (not shown) may be substituted for the paving breaker and used to effect compaction. When the job is completed, the tools may be stored in the aforedescribed compartments, excess emulsion may be removed from emulsion tank 55, the system may be flushed with deisel oil or other solvent in tank 130, and the various hoses may be reeled up.

I claim:

1. In combination:

a vehicle;

an engine for propelling said vehicle;

first and second hydraulic pumps on said vehicle driven by said engine;

and apparatus mounted on said vehicle and including: first and second hydraulic motors driven by said first and second pumps, respectively;

an air compressor driven by said first hydraulic motor;

a compressed air tank supplied by said air compressor;

a pneumatic circuit supplied by said compressed air tank and operable to supply compressed air to drive a pneumatically powered tool;

an emulsion tank;

an emulsion pump driven by said second hydraulic motor for expelling emulsion from said emulsion tank;

and a hydraulic circuit supplied by said first hydraulic pump and operable to supply pressurized fluid to drive a hydraulically powered tool.

2. A combination according to claim 1 wherein said vehicle further includes a tiltable dump box and a hydraulically operable tilt cylinder for said dump box;

and wherein said first hydraulic pump further operates to supply pressurized fluid to operate said tilt cylinder;

and wherein said apparatus is mounted on said dump box.

3. A combination according to claim 1 or 2 wherein said apparatus is detachably mounted.

4. A combination according to claim 1 or 2 wherein said first hydraulic pump connects to a hose on a hose reel on said vehicle;

wherein said pneumatic circuit includes a hose connected to a hose reel on said apparatus;

and wherein said emulsion pump connects to a hose on another hose reel on said apparatus.

5. A combination according to claim 1 or 2 including hoses connected between said hydraulic pumps and said hydraulic motors, and a separable hose connectors in said hoses.

6. In combination:

a vehicle having a chassis;

an engine on said chassis for propelling said vehicle;

a fluid cooling system on said chassis for said engine;

first and second hydraulic pumps on said chassis driven by said engine;

a hydraulic fluid reservoir on said chassis for supplying hydraulic fluid to said hydraulic pumps;

a dump box tiltably mounted on said chassis;

a hydraulically operable tilt cylinder connected between said chassis and said dump box;

apparatus detachably mounted on said dump box and including:

first and second hydraulic motors supplied and driven by said first and second hydraulic pumps, respectively;

an air compressor driven by said first hydraulic motor;

a compressed air tank supplied by said air compressor;

a pneumatic circuit supplied by said compressed air tank and operable to supply compressed air to drive a pneumatically powered tool;

an emulsion tank;

an emulsion pump driven by said second hydraulic motor for expelling emulsion from said emulsion tank;

heater means arranged to heat said emulsion tank and said second hydraulic motor;

a hydraulic circuit supplied by said first hydraulic pump and operable to supply pressurized fluid to drive a hydraulically powered tool and to operate said tilt cylinder;

hydraulic fluid supply lines connected between said hydraulic pumps and said hydraulic motors;

a hydraulic fluid return line connected between said hydraulic motors and said reservoir;

fluid coolant supply and return lines connected between said fluid cooling system and said heater means;

and detachable connector means in said hydraulic fluid supply and return lines and in said fluid coolant supply and return lines to facilitate detachment and connection between said apparatus and said dump box.

7. A combination according to claim 6 wherein said first hydraulic pump connects to a hose or a hose reel on said chassis;

wherein said pneumatic circuit includes a hose connected to a hose reel on said apparatus;

and wherein said emulsion pump connects to a hose on another hose reel on said apparatus.

* * * * *